US007195196B2

(12) United States Patent
Ko

(10) Patent No.: US 7,195,196 B2
(45) Date of Patent: Mar. 27, 2007

(54) PAPER HOLDER WITH ELECTRONIC ENTERTAINMENT SYSTEM

(76) Inventor: Gordon Ko, 10 Pala Mesa Dr., Phillips Ranch, CA (US) 91766

( * ) Notice: Subject to any disclaimer, the term of this patent is extended or adjusted under 35 U.S.C. 154(b) by 141 days.

(21) Appl. No.: 10/402,756

(22) Filed: Mar. 28, 2003

(65) Prior Publication Data

US 2004/0192381 A1 Sep. 30, 2004

(51) Int. Cl.
*B65H 16/06* (2006.01)

(52) U.S. Cl. ..... 242/598.5; D6/519; D6/523; D14/189

(58) Field of Classification Search ..... 242/598, 242/598.3, 598.5, 598.6; D14/188, 189; D6/519, 522, 523
See application file for complete search history.

(56) References Cited

U.S. PATENT DOCUMENTS

D214,839 S * 8/1969 Louis ..... D6/519
D376,597 S * 12/1996 Hiller ..... D14/189
5,878,893 A * 3/1999 Micienko ..... 211/13.1
D484,483 S * 12/2003 Chan ..... D14/168

* cited by examiner

*Primary Examiner*—John Q. Nguyen

(57) ABSTRACT

A paper holder with electronic entertainment system is disclosed wherein an electronic entertainment system is built into a paper holder that can be used safely and conveniently to entertain the user. The paper holder with electronic entertainment system does not detract from the decor in the restroom and does not need to be removed from the restroom after use. The electronic entertainment system may be an AM/FM radio, a compact disc (CD) player, a DVD player, a cassette player, or any other suitable electronic entertainment systems.

13 Claims, 2 Drawing Sheets

PAPER HOLDER WITH ELECTRONIC ENTERTAINMENT SYSTEM

BACKGROUND—FIELD OF INVENTION

The present invention relates generally to a paper holder with a source of electronic entertainment. More specifically, the present invention relates to a paper holder with a built-in AM/FM radio.

BACKGROUND—DESCRIPTION OF RELATED ART

The average restroom is usually the room with the least amount of electrical and electronic equipments in the house. Although every person spends some time in the restroom everyday, sometimes for lengthy durations, there is usually no entertainment or anything else to do while the person is in there. Therefore, many people bring magazines, newspapers, books, and other reading materials into the restroom to keep them entertained.

Other people will bring portable televisions, radios, and other electronic entertainments into the restroom. However, most of the portable electronic products are not designed specifically to be used in a restroom. They are either too bulky or too dangerous to be used near water. Furthermore, the portable electronic products generally must be removed from the restroom afterwards due to their bulk and the electrical hazard they present near water. In addition, the portable electronic product, if left in the restroom, will generally detract from the decor in the restroom and is not aesthetically desirable.

The most common electronic entertainment that is specifically designed for the restroom is the waterproof radio that is used in the shower. However, generally, the shower radio is installed or hanged in the shower, away from the toilet and cannot be reached or operated away from the showering position. Operating and enjoying the radio is difficult and inconvenient from any position other than when the operator is in the shower.

SUMMARY OF THE INVENTION

The present invention comprises of an electronic entertainment system built into a paper holder that can be used safely and conveniently to entertain the user while the user is using the toilet. The paper holder with electronic entertainment system does not detract from the decor in the restroom and does not need to be removed from the restroom after use. The electronic entertainment system may be an AM/FM radio, a compact disc (CD) player, a DVD player, cassette player, or any other suitable electronic entertainment systems.

DETAILED DESCRIPTION OF THE PREFERRED EMBODIMENT

Figure 1:
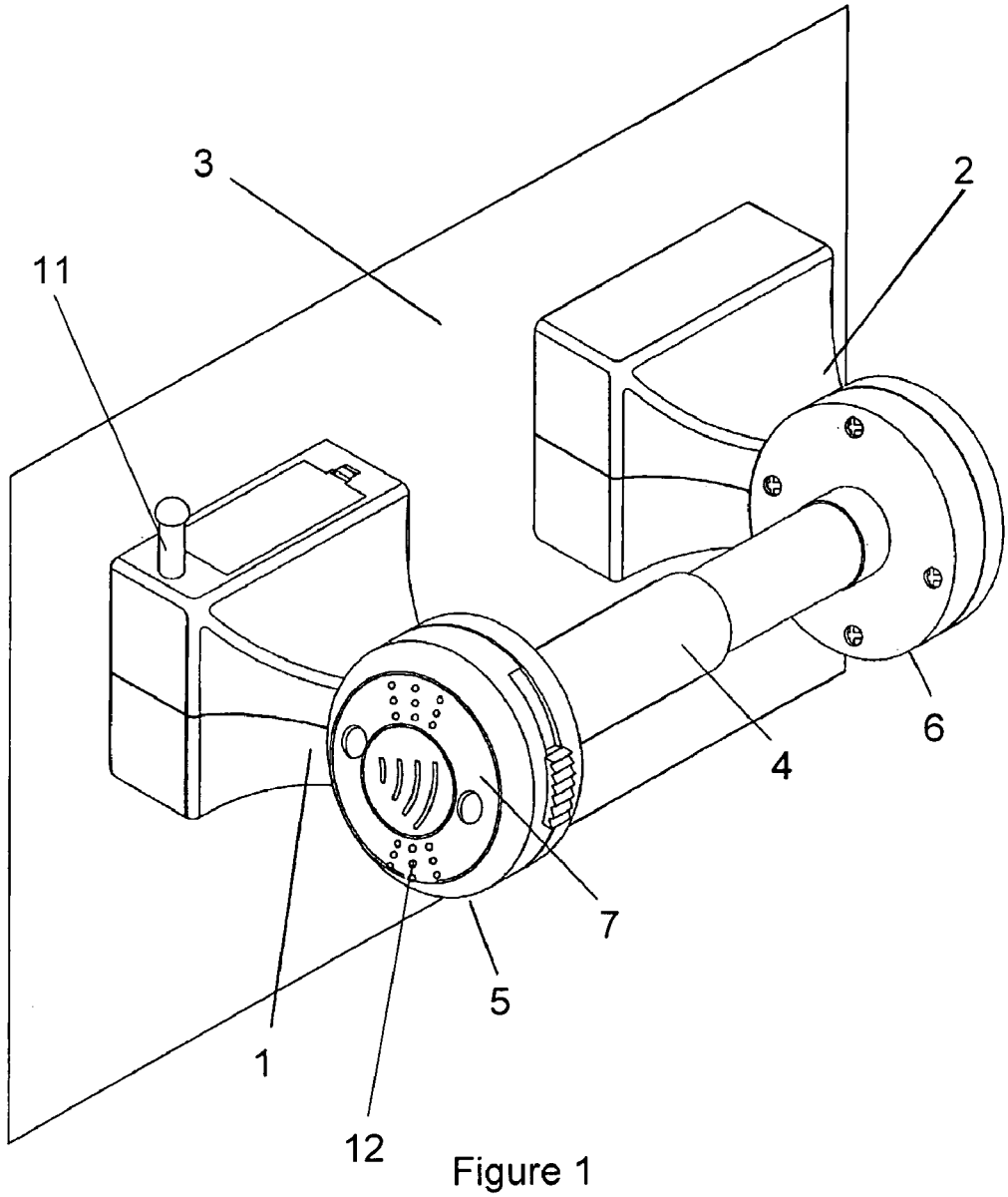
FIG. 1 shows the preferred embodiment of the paper holder with electronic entertainment system.

FIG. 1 shows the preferred embodiment of the present invention. The present invention is a paper holder with electronic entertainment system comprising a paper holder with two arms 1, 2 that can be mounted to a surface 3 such as a wall or under a cabinet with screws or adhesives, a compressible column 4 removably mounted between the free ends 5, 6 of the two arms 1, 2 to retain the toilet paper through the paper core of the toilet paper, and an AM/FM radio 7 contained within one arm 1 of the paper holder with electronic entertainment system. In the preferred embodiment, the AM/FM radio 7 is battery operated with the battery installed within the end of one arm 1 of the paper holder with entertainment system that is mounted to the surface 3 and the antenna of the AM/FM radio 7 either contained within or extending from the end of the arm 1 of the paper holder with electronic entertainment system that is mounted to the surface 3. Naturally, the AM/FM radio 7 may also be hardwired to the house electrical system to be powered by AC power through a transformer instead of batteries. The AM/FM radio 7 is enclosed within the free end 5 of the arm 1 of the paper holder with electronic entertainment system with the battery and the antenna at the other end. The AM/FM radio 7 is within easy and convenient reach of the user while using the toilet and is safe from water contact with the radio. Furthermore, since the radio is inconspicuously incorporated into the paper holder, the paper holder with electronic entertainment system does not detract form the decor in the restroom and can remain as a permanent fixture in the restroom. Naturally, other sources of electronic entertainments, such as a compact disc (CD) player, DVD player, cassette player, or shortwave radio, may also be used in place of the radio.

Figure 2:
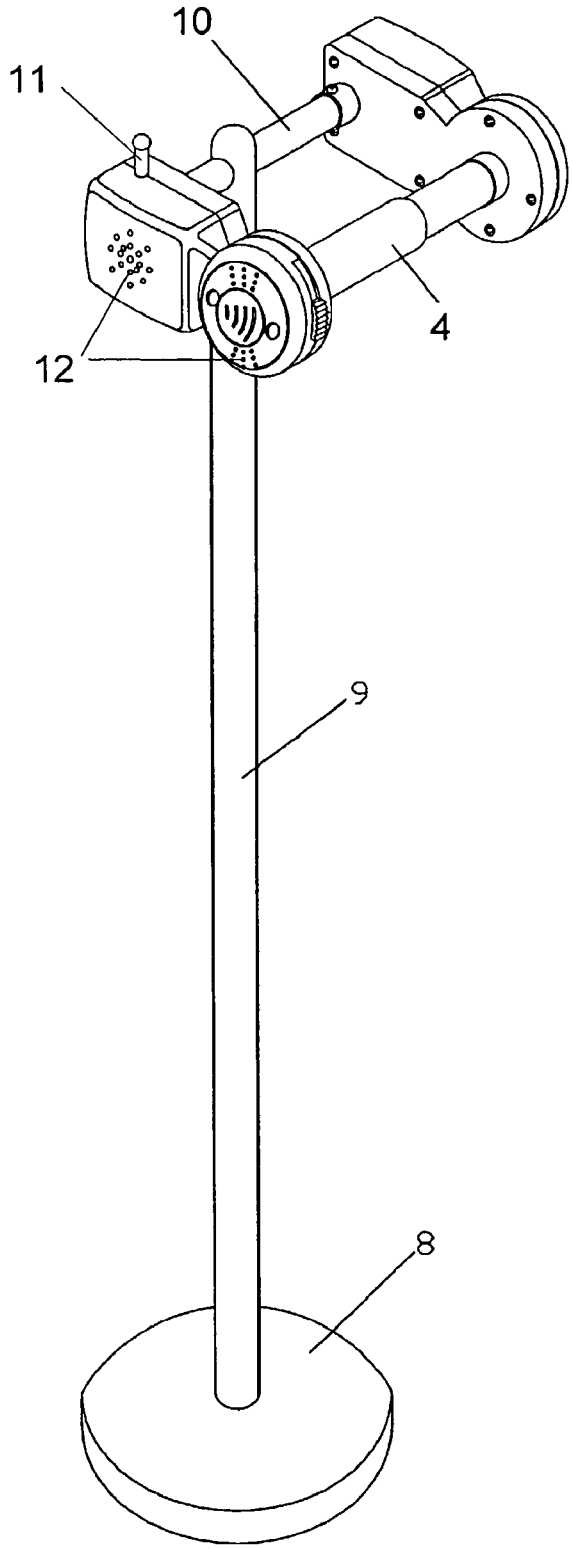
FIG. 2 shows another embodiment of the paper holder with electronic entertainment system wherein the paper holder with electronic entertainment system is free standing and portable.

FIG. 2 shows another embodiment of the present invention. In this embodiment, the paper holder with electronic entertainment system is mounted to a free standing stand that can be moved and placed at any convenient locations. The stand may comprise of a weighted base 8 with a vertical member 9 extending therefrom with a predetermined height for convenient location of the toilet paper. The paper holder with electronic entertainment system may be mounted to the vertical member 9 with a variety of mounting means such as the one shown in FIG. 2 wherein the mounting means is a horizontal member 10 that extends from the top of the vertical member 9 to attach to the paper holder with electronic entertainment system. This embodiment allows the paper holder with electronic entertainment system to be portable and able to be moved from one room to another.

The paper holder with electronic entertainment system may also be used to hold paper towels of varying widths simply by changing the compressible column 4 between the free ends 5, 6 of the two arms 1, 2 and varying the distance between the two arms 1, 2 of the paper holder with electronic entertainment system. In addition, the paper holder with electronic entertainment system may also be used as a bath towel holder by using an appropriate length of the compressible column 4 and varying the distance between the two arms 1, 2 of the paper holder with electronic entertainment system.

Although the description above contains many specificities, these should not be construed as limiting the scope of the invention but as merely providing illustrations of some of the presently preferred embodiments of this invention. Thus the scope of the invention should be determined by the appended claims and their legal equivalents, rather than by the examples given.

In FIGS. 1 and 2 are shown an antenna 11 and speskers 12.

What is claimed is:

1. A paper holder with electronic entertainment system comprising: a first arm containing an electronic entertainment system with one end attachable to a surface and a free end; a second arm with one end attachable to a surface and a free end; and a compressible member inserted between the free end of said first arm and the free end of said second arm; wherein the paper holder with electronic entertainment system will hold a roll of toilet paper and provide entertainment with the electronic entertainment system.

2. A paper holder with electronic entertainment system according to claim 1, wherein the electronic entertainment system is a radio.

3. A paper holder with electronic entertainment system according to claim 2, wherein the radio is battery powered.

4. A paper holder with electronic entertainment system according to claim 2, wherein the radio is powered by hardwriting it to a house electrical system.

5. A paper holder with electronic entertainment system according to claim 1, wherein the paper holder with electronic entertainment system is attached to a vertical wall.

6. A paper holder with electronic entertainment system according to claim 1, wherein the paper holder with electronic entertainment system is attached under a cabinet.

7. A paper holder with electronic entertainment system according to claim 1, wherein the paper holder with electronic entertainment system will hold a roll of paper towel.

8. A paper holder with electronic entertainment system according to claim 1, wherein the paper holder with electronic entertainment system will hold a bath towel.

9. A paper holder with electronic entertainment system comprising: a first arm with one end containing a speaker, one or more batteries, and an antenna attachable to a surface and a free end containing a radio; a second arm with one end attachable to a surface and a free end; and a compressible member inserted between the free end of said first arm and the free end of said second arm; wherein the paper holder with electronic entertainment system will hold a roll of toilet paper and provide audio entertainment in the form of radio broadcasts.

10. A paper holder with electronic entertainment system according to claim 9, wherein the paper holder with electronic entertainment system is attached to a vertical wall.

11. A paper holder with electronic entertainment system according to claim 9, wherein the paper holder with electronic entertainment system is attached under a cabinet.

12. A paper holder with electronic entertainment system according to claim 9, wherein the paper holder with electronic entertainment system will hold a roll of paper towel.

13. A paper holder with electronic entertainment system according to claim 9, wherein the paper holder with electronic entertainment system will hold a bath towel.

* * * * *